US007212094B2

(12) United States Patent
Matsutani et al.

(10) Patent No.: US 7,212,094 B2
(45) Date of Patent: May 1, 2007

(54) INDUCTIVE COMPONENTS AND ELECTRONIC DEVICES USING THE SAME

(75) Inventors: Nobuya Matsutani, Katano (JP); Akihiko Ibata, Takaishi (JP); Yoshihisa Takase, Higashiosaka (JP); Takeshi Takahashi, Yawata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 263 days.

(21) Appl. No.: 10/502,162

(22) PCT Filed: Oct. 30, 2003

(86) PCT No.: PCT/JP03/13894

§ 371 (c)(1),
(2), (4) Date: Jul. 21, 2004

(87) PCT Pub. No.: WO2004/040597

PCT Pub. Date: May 13, 2004

(65) Prior Publication Data

US 2005/0068150 A1 Mar. 31, 2005

(30) Foreign Application Priority Data

Oct. 31, 2002 (JP) ..... 2002-318360

(51) Int. Cl.
*H01F 5/00* (2006.01)

(52) U.S. Cl. ..... 336/200

(58) Field of Classification Search ..... 336/65, 336/83, 200, 232, 233–234; 257/531
See application file for complete search history.

(56) References Cited

FOREIGN PATENT DOCUMENTS

| | | | |
|---|---|---|---|
| JP | 04-056112 | * | 2/1992 |
| JP | 4-56113 A | | 2/1992 |
| JP | 6-349637 A | | 12/1994 |
| JP | 9-223636 A | | 8/1997 |

OTHER PUBLICATIONS

International Search Report for PCT/JP2003/13894, dated Feb. 10, 2004.

* cited by examiner

*Primary Examiner*—Tuyen T. Nguyen
(74) *Attorney, Agent, or Firm*—RatnerPrestia

(57) ABSTRACT

An inductive component in which a large enough inductance is obtainable even when the size is made smaller and the profile is made lower and electronic devices using the inductive component are provided. The inductive component includes a coil, a through hole inside the coil, and a multilayer magnetic layer, and the multilayer magnetic layer is disposed on the top and the bottom surfaces of the coil and the inner wall of the through hole.

21 Claims, 6 Drawing Sheets

INDUCTIVE COMPONENTS AND ELECTRONIC DEVICES USING THE SAME

THIS APPLICATION IS A U.S. NATIONAL PHASE APPLICATION OF PCT INTERNATIONAL APPLICATION PCT/JP2003/013894.

TECHNICAL FIELD

The present invention relates to inductive components for use in power supply circuits of portable telephones and the like and to electronic devices using the inductive components.

BACKGROUND ART

Referring to FIG. 11, a description of power supply circuits for use in portable telephones and the like will be given.

Using a voltage of 4V, for example, of battery 101 as the input voltage, it is possible to obtain an output voltage of 2V. Here, coil 102 is called a choke coil. By putting coil 102 in the circuit, a stable output voltage can be obtained. Also, in order to more stabilize the output voltage, it is necessary to increase the inductance of coil 102. In this way, the power supply circuit of FIG. 11 is capable of supplying a DC output voltage which is more stabilized.

Generally, in order to increase the inductance of coil 102, it is necessary to increase the cross-sectional area of the core of coil 102 and to increase the number of turns. This presents a problem of a need to increase the volume of coil 102. On the other hand, in association with the requirement in recent years for a smaller size and lower profile design of portable telephones, there is an increasingly stronger requirement for smaller size and lower profile design of coils for the power supply circuit of portable telephones. For example, coil 102 with an area smaller than 5 mm×5 mm and a thickness of less than 1 mm is being required. Furthermore, the switching frequency has increased from several hundred kHz to several tens of MHz. In association with such a trend toward higher frequencies of the switching frequency, reduction in the core loss is being required. Also, as devices have come to be used at lower voltages and higher currents, there is a case in which a maximum current greater than 0.1 A flows in a coil having a small size and a low profile. For this reason, it is necessary to reduce the resistance of the coil to a lower value.

Japanese Laid-Open Patent Application No. H09-223636 (page 3, FIG. 1) discloses a method for solving these issues.

Referring to FIG. 12, a description of a conventional inductive component will be given. Multilayer magnetic films 112 support coil 111 in a manner sandwiching with the intervention of interlayer insulating layer 115. And through-hole sections (hereinafter "THP") 114 are provided on the sides and in the center of coil 111. Furthermore, THP 114 is filled with magnetic material 113. Also, as coil 111 is formed by winding a strip of high electric-conductivity materials such as copper, coil 111 can be made thin. However, the above-mentioned coil with a conventional configuration suffered a problem that the inductance could not be increased to a high enough value. Furthermore, as magnetic layer 113 is formed inside THP 114, the cross-sectional area of magnetic layer 113 becomes large. When a current is fed through coil 111, a magnetic flux that vertically penetrates THP 114 is generated, and an eddy current is generated in the horizontal plane of magnetic layer 113. As the cross-sectional area of magnetic layer 113 is large, the eddy current is large.

As a result, the magnetic flux that vertically penetrates THP 114 is reduced.

Consequently, the inductance of the coil cannot be increased. On the other hand, by using a magnetic material having a higher specific resistance, the eddy current can be reduced to a certain extent. However, when the switching frequency increases from several hundred kHz to several tens of MHz, a satisfactory effect of eddy current reduction cannot be obtained. Also, when the diameter of a through hole is 1 mm or smaller, and the depth is 0.1 mm or greater and 1 mm or smaller, for example, it is difficult to fill or dispose a magnetic material into the THP by sputtering or vapor deposition because of difficulties in quality and productivity. The present invention addresses these issues and provides inductive components with which sufficient inductance is obtainable even when designed with a smaller size and a lower profile, and electronic devices that use those inductive components.

SUMMARY OF THE INVENTION

The present invention provides an inductive component including a coil, a through hole part and a multilayer magnetic layer, wherein the multilayer magnetic layer is disposed on the inner wall of the through hole part and the top and the bottom surfaces of the coil.

DETAILED DESCRIPTION OF PREFERRED EMBODIMENT FOR CARRYING OUT THE INVENTION

Referring to drawings, a description of preferred embodiments of the present invention will be given in the following. The drawings are schematic diagrams and do not represent dimensionally correct positions.

(Embodiment 1)

Figure 1:
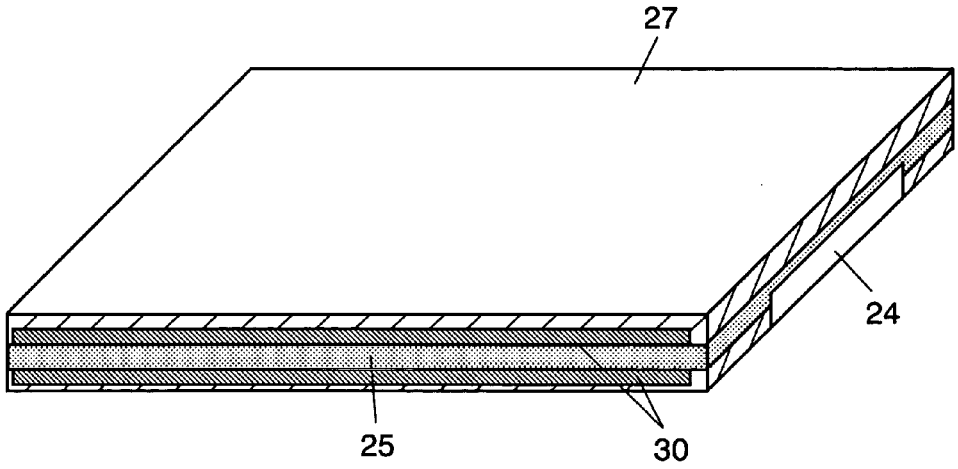
FIG. 1 is a perspective view of an inductive component of Embodiment 1 of the present invention.
Figure 2:
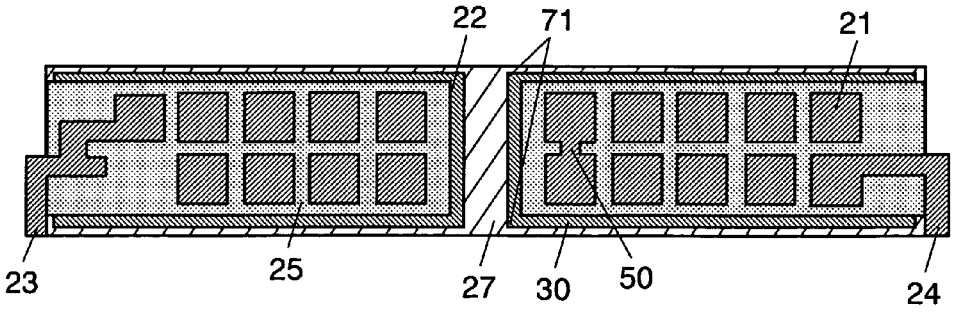
FIG. 2 is a cross-sectional view of an inductive component of Embodiment 1 of the present invention.

FIG. 1 and FIG. 2 illustrate an inductive component of Embodiment 1. In FIG. 2, coil 21 and through-hole electrode 50 are formed with a plated high-conductivity material such as copper and silver. Needless to say, coil 21 may be formed with a copper wire. THP 22 is formed in the center of coil 21. Depending on the occasion, THP 22 may be formed on the outside of coil 21. While the thickness of coil 21 differs depending on the device in which it is to be used, at least a thickness of 10 μm is necessary in order to cope with a large current. Also, the coil on the upper level of coil 21 is spirally wound toward THP 22 starting from terminal 23 located on one of the sides of the inductive component. The coil then moves to the lower level at the center and is spirally wound toward terminal 24 located at the other side of the inductive component starting from through-hole electrode 50. Here, the directions of winding of the upper level and lower level coils of coil 21 are the same. Accordingly, when a current is fed from terminal 23, it spirally flows from a side of the inductive component toward the center through the upper level of coil 21. The current further flows from the upper level to the lower level, and spirally flows through the lower level of coil 21 from the center of the inductive component toward the side, and is put out from terminal 24. Coil 21 may not necessarily be of two levels and may be of one level or three or more levels. Coil 21 is buried inside coil insulating material 25. Coil insulating material 25 prevents coil 21 from short-circuiting.

Next, multilayer magnetic layer (hereinafter "MLM") 30 is disposed on the top surface of coil 21 and the inner wall of THP 22 is formed at the same time. Here, MLM 3O consists of magnetic layers 26 and insulating layers 29. Furthermore, MLM 30 is also formed on the bottom surface of coil 21. Insulating material 27 is formed in a manner covering MLM 30. That is, it covers MLM 30 on the top and bottom surfaces of coil 21 as well as MLM 30 inside THP 22. Insulating material 27 is also filled in the space formed by MLM 30 inside THP22. Insulating material 27 is provided in order to prevent short-circuit when mounting the inductive component on an electronic component in a state in which MLM 30 is exposed.

While FIG. 2 illustrates a state in which the space formed by MLM 30 inside THP22 is totally filled with insulating material 27, it is not necessary to totally fill the space. However, when sucking and mounting the inductive component on a substrate, it is more preferable that insulating material 27 be totally filling the space formed by MLM 30 inside THP 22. Also, as insulating material 27, an organic resin such as epoxy resin, silicone resin, or acrylic resin is preferable.

In FIG. 2, although all of MLM 30 is formed into an integrated unit, it need not necessarily be integrated. However, in order not to produce a magnetic gap, it is preferable to form a continuous magnetic layer at corner section 71 of THP 22 where magnetic fluxes tend to concentrate most intensely. By forming the magnetic layer in this way, leakage flux can be made smaller and inductance can be made larger. By the way, a magnetic material may be disposed on MLM 30 inside THP 22. When doing this, it is more preferable that the magnetic material be brought into as intimate contact as possible in order not to produce a magnetic gap. Also, the magnetic material is made of at least one material selected from the group consisting of a ferrite magnetic material, a composite of ferrite magnetic powder and an insulating resin, and a composite of metal magnetic powder and an insulating resin. With this configuration, superior reliability is obtainable as superior insulation can be obtained and possibility of occurrence of short-circuit in the circuit can be reduced even without insulating material 27.

Figure 3:
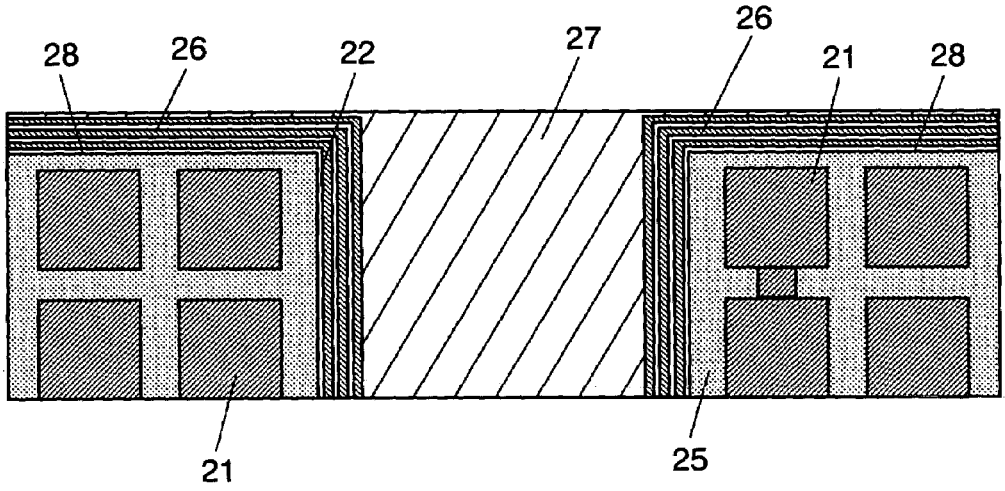
FIG. 3 is an enlarged cross-sectional view of THP of Embodiment 1 of the present invention.

FIG. 3 is an enlarged cross-sectional view of THP 22. Plating under-layer 28 is provided in order to form MLM 30 on coil insulating material 25. That is, it is provided to facilitate formation of magnetic layer 26 on plating under-layer 28 by electroplating. Plating under-layer 28 is formed by electroless plating, for example, and copper, nickel or metal magnetic layer having good conductivity is preferably used.

Figure 4:
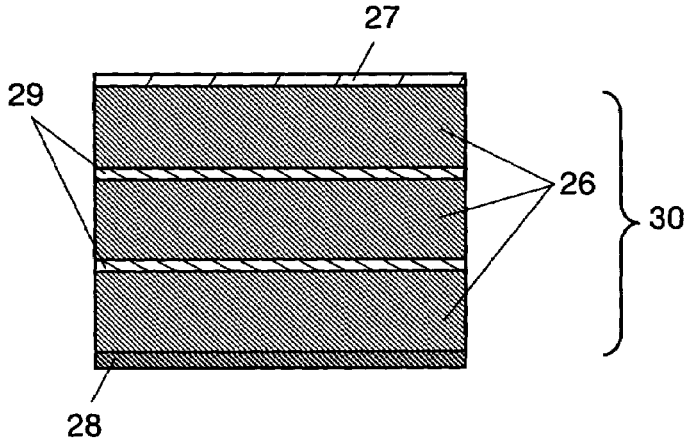
FIG. 4 is an enlarged cross-sectional view of the top surface of a coil of Embodiment 1 of the present invention.

MLM 30 is formed in a manner such that insulating layer 29 interposes magnetic layers 26 as illustrated in FIG. 4. MLM 30 is formed as follows. First, magnetic layer 26 is formed by electroplating on plating under-layer 28 followed by forming insulating layer 29 on top of it by electroplating or electrodeposition. Furthermore, thin MLM 30 can be formed by succeedingly forming a magnetic layer, an insulating layer, and a magnetic layer. In FIG. 4, MLM 30 has three layers. However, the number of the magnetic layers may be one or two, or four or more. Same thing applies to the structure of MLM 30 to be disposed under the coil. Furthermore, when forming MLM 30, in order to facilitate formation of a magnetic layer by electroplating, an under layer similar to plating under-layer 28 may be provided between the insulating layer and the magnetic layer. The magnetic layer may be formed by electroplating. Needless to say, similar advantage is obtainable by laminating MLM 30 by a method other than what is described above so far as the structure is the same.

MLM 30 is formed in a manner such that the main component of at least one of the layers of MLM 30 includes at least one element selected from the group consisting of Fe, Ni, and Co. In this way, a magnetic layer having superior magnetic properties for satisfying requirement for a high saturation magnetic flux density and a high magnetic permeability to cope with a large current can be obtained, and a high inductance can be realized. Thickness of each of the magnetic layers differs depending on the switching frequency. Assuming a switching frequency range of several hundred kHz to several tens of MHz, the thickness is preferably between 1 μm to 50 μm. Also, while the thickness of each insulating layer differs depending on the specific resistance, the preferable range is from 0.01 μm to 5 μm. While the specific resistance of the insulating layer is the higher the better, the insulating layer is effective so far as the ratio of its specific resistance to that of the magnetic layer is $10^3$ or higher. As the material for the insulating layer, organic resins or inorganic materials such as metal oxides are preferable. A mixture of these materials is also good.

Figure 5:
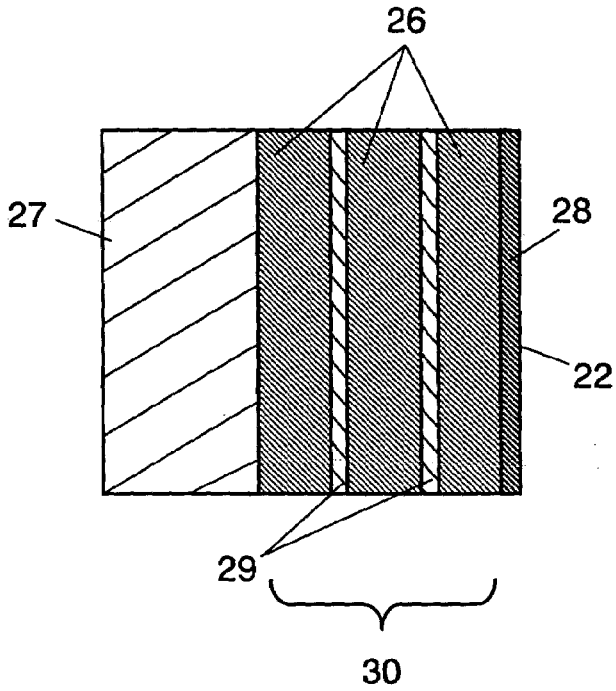
FIG. 5 is an enlarged cross-sectional view of the inner wall of THP of Embodiment 1 of the present invention.

FIG. 5 is an enlarged cross-sectional view of the inner wall of THP 22. As shown in FIG. 5, MLM 30 is formed in a manner such that insulating layer 29 interposes between magnetic layers 26. MLM 30 is formed as described below. First, magnetic layer 26 is formed by electroplating on top of plating under-layer 28 followed by formation of insulating layer 29 by electroplating or electrodeposition. MLM 30 is formed by further sequentially forming a magnetic layer, an insulating layer, and a magnetic layer on top of insulating layer 29. In this way, the cross-sectional area of the magnetic layer per layer of MLM 30 is sufficiently minimized by electroplating. In FIG. 5, MLM 30 has three layers. However, the number of the magnetic layers may be one or two, or four or more.

Furthermore, in forming MLM 30, an under layer similar to plating under-layer 28 may be provided between the insulating layer and the magnetic layer in order to facilitate the formation of magnetic layer 26 by electroplating. The magnetic layer may also be formed by electroless plating. Needless to say, when MLM 30 is formed by a method other than the above described, the same advantage is obtainable so far as the structure is the same. MLM 30 is formed in a manner such that the main component of at least one layer of MLM 30 includes at least one element selected from the group consisting of Fe, Ni, and Co. In this way, MLM 30 having superior magnetic properties for satisfying a requirement for a high saturation magnetic flux density and a high magnetic permeability to cope with a large current can be obtained. At the same time, a high inductance can be realized. Preferable thickness of each of the magnetic layers differs depending on the switching frequency. Assuming a switching frequency range of several hundred kHz to several tens of MHz, the thickness is preferably between 1 μm to 50 μm. While the thickness per layer of the insulating layers differs depending on the specific resistance, the preferable range is from 0.01 μm to 5 μm.

Also, while the specific resistance of the insulating layers is the higher the better, the insulating layer is effective so far as the ratio of its specific resistance to that of the magnetic layer is $10^3$ or higher. As the material for the insulating layers, organic resins or inorganic materials such as metal oxides are preferable.

Furthermore, a mixture of these materials is also good. A description of operation of an inductive component having above configuration will now be given in the following. Coil 21 is spirally wound with high regularity and has a two-level structure with the same direction of winding. For this reason, when a current is fed to coil 21, a strong magnetic flux is obtainable enabling an increase in the inductance of the inductive component. Accordingly, an inductive component having a large enough inductance is obtainable even when the size is made smaller and the profile is made lower. Also, coil 21 is formed by copper plating and the like and its cross-section is a square. The advantage of square cross-section of coil 21 lies in that the cross-sectional area can be made greater than that obtainable when the cross-section of coil 21 is round. As a result, coil 21 with a low electric resistance, a small size, and a low profile is obtainable.

By using a coil having a high space factor like this, copper loss generated in the coil can also be reduced. When a current is fed to an inductive component, a magnetic flux is generated in the inductive component. Magnetic fluxes are also generated in the direction of the plane of MLM 30 disposed on the top and the bottom surfaces of coil 21. A magnetic flux is also generated in the direction of the plane of MLM 30 formed on the inner wall of THP 22. Because of these fluxes, an eddy current is generated in the direction of the thickness of MLM 30. As this eddy current reduces the magnetic flux generated in the direction of the plane of MLM 30, the inductance of the inductive component decreases.

Also, the eddy current generated in the direction of thickness of MLM 30 causes heat generation from the inductive component. However, in the inductive component of this embodiment, MLM 30's are formed on the top and the bottom surfaces of coil 21. As a result, the cross-sectional area per layer of MLM 30 in the direction of the thickness becomes small enough relative to the eddy current. Furthermore, as MLM 30 is formed on the inner wall of THP 22, the cross-sectional area per layer of MLM 30 in the direction of the thickness is made small enough. As the eddy current generated in the direction of the thickness of MLM 30 can be suppressed, reduction of the flux generated in the direction of the plane of MLM 30 can be prevented. Inductance of the inductive component can be made large in this way. Also, heat generation from the inductive component can be suppressed.

On the other hand, it is difficult to form MLM 30 by sputtering or vapor deposition on the inner wall of THP 22 of which the diameter is 1 mm or smaller and the depth is 0.1 mm or greater and 1 mm or smaller, for example. Formation by plating is most preferable. In this way, an inductive component having a large enough inductance is obtainable. As a large enough inductance is obtainable with the inductive component of this embodiment even when designed with a smaller size and a lower profile as noted above, it can be mounted in various small electronic devices such as portable telephones.

(Embodiment 2)

Figure 6:
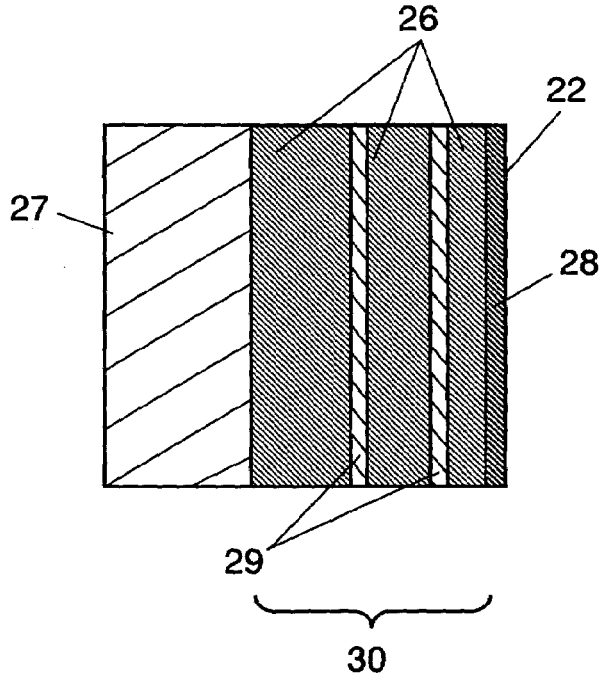
FIG. 6 is an enlarged cross-sectional view of the inner wall of THP of Embodiment 2 of the present invention.

Referring to FIG. 6, a description of an inductive component in Embodiment 2 will now be given. Basic structure of the inductive component is the same as that of the inductive component of Embodiment 1. What is different from embodiment 1 is that the thicknesses of each of magnetic layers 26 that compose MLM 30 are different. In FIG. 6, MLM 30 is formed in a manner such that each of magnetic layers 26 is separated by insulating layer 29. MLM 30 is formed as described below. First, magnetic layer 26 is formed by electroplating on top of a plating under-layer followed by formation of insulating layer 29 by electroplating or electrodeposition. MLM 30 is completed by further sequentially forming a magnetic layer, an insulating layer, and a magnetic layer. In this way, the cross-sectional area per layer of the magnetic layers of MLM 30 is made small enough. Differently from Embodiment 1, MLM 30 to be formed on the inner wall of THP 22 of the inductive component in this Embodiment is formed in the following way. MLM 30 is formed in a manner such that the thickness of each of magnetic layers 26 that compose MLM 30 increases as magnetic layer 26 comes closer to the center of coil 21. In FIG. 6, though MLM 30 has three magnetic layers, the number of layers may be two or four or more. Also, in forming MLM 30, an under layer similar to plating under-layer 28 may be provided between an insulating layer and a magnetic layer to facilitate formation.

A description of the operation of the inductive component as formed above will now be given in the following. When a current is fed to coil 21, a magnetic flux is generated. This magnetic flux creates a magnetic circuit primarily along the outer wall, the top surface, the bottom surface, and the inner wall of THP 22 of coil 21. The magnetic flux of the outer side of the magnetic circuit is weaker as the magnetic path length is greater. The magnetic flux generated in the direction of the plane of MLM 30 formed on the inner wall of THP 22 shifts toward the outside of the magnetic circuit formed by MLM 30 as the center of coil 21 becomes nearer.

And, as the magnetic path length becomes greater, the magnetic flux becomes weaker. As a result, the flux penetrating MLM 30 formed on the inner wall of THP 22 becomes non-uniform. However, in this Embodiment, each of magnetic layers 26 of MLM 30 formed on the inner wall of THP 22 is formed in a manner such that its thickness increases as the center of coil 21 becomes nearer. As a result, the magnetic resistances of each of magnetic layers 26 are unified. And the magnetic flux penetrating each of magnetic layers 26 of MLM 30 in the direction of the plane will not become weaker as the center of coil 21 becomes nearer. As a result, the magnetic flux that penetrates MLM 30 formed on the inner wall of THP 22 will become uniform thus reducing the leakage flux. As is set forth above, in the inductive component of this Embodiment, the magnetic flux that penetrates MLM 30 formed on the inner wall of THP 22 of coil 21 becomes uniform. As a result, the leakage flux can be reduced and a larger inductance can be obtained.

(Embodiment 3)

Figure 7:
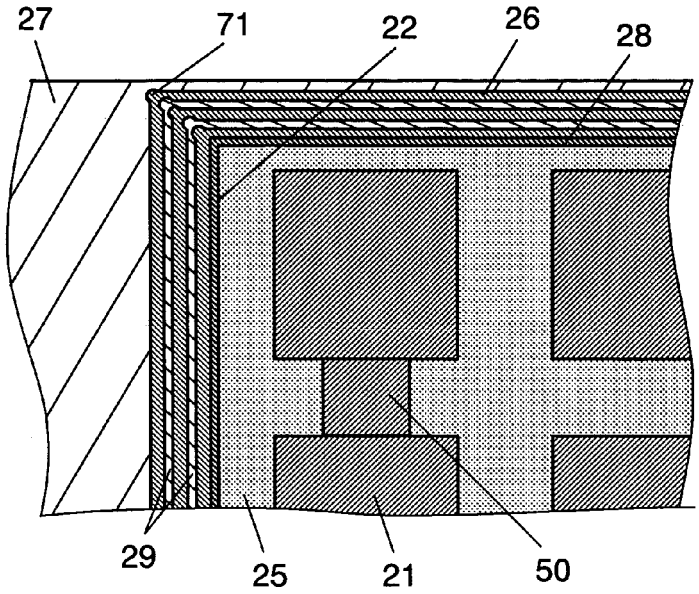
FIG. 7 is an enlarged cross-sectional view of a corner section of a multilayer magnetic layer of Embodiment 3 of the present invention.

Next, a description of an inductive component in this Embodiment will be given referring to FIG. 7. The basic structure of the inductive component is the same as that of the inductive component of Embodiment 1. Difference lies in that the thicknesses of the magnetic layers of corner section 71 consisting of MLM 30 formed on the inner wall of THP 22 of coil 21 and MLM 30 disposed on the top and the bottom surfaces of the coil are made thicker. In FIG. 7, corner section 71 is formed in a manner such that the thicknesses of magnetic layers of MLM 30 become thicker. As a result, the cross-sectional area in the direction of the thickness of MLM 30 at corner section 71 is made greater than the cross-sectional area in the direction of the thicknesses of MLM 30 disposed on the top and the bottom surfaces of coil 21 and MLM 30 formed on the inner wall of THP 22.

A description of the operation of an inductive component having the above configuration will now be given below. When a current is fed to coil 21, a magnetic flux is generated. This magnetic flux forms a magnetic circuit primarily along the outer wall, the top surface, and the bottom surface of coil 21, and the inner wall of THP 22. Furthermore, a magnetic flux is also generated in the direction of the plane of MLM 30. The magnetic flux in the direction of the plane of MLM 30 is easy to leak from the magnetic circuit formed by MLM at corner section 71 of MLM 30 of THP 22 where the magnetic flux concentrates most easily.

However, the inductive component in this Embodiment is formed in a manner such that the thicknesses of each of the magnetic layers of MLM 30 at corner section 71 are greater. Accordingly, the cross-sectional area of MLM 30 in the direction of thickness is made greater at corner section 71, and the magnetic resistance at corner 71 against the magnetic flux that penetrates MLM 30 in the direction of the plane becomes smaller. As a result, leakage from the magnetic circuit formed by MLM 30 at corner section 71 of the magnetic flux that penetrates MLM 30 in the direction of the plane can be prevented.

Inductance of the inductive component can be increased in this way. In summary, an inductive component having a large enough inductance is obtainable according to this Embodiment.

(Embodiment 4)

Figure 8:
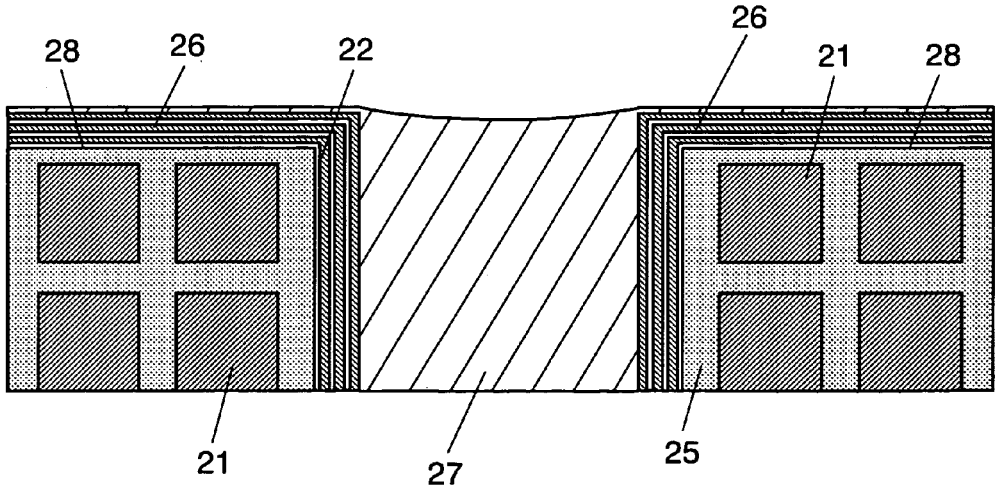
FIG. 8 is an enlarged cross-sectional view of the top section of THP of Embodiment 4 of the present invention.

Next, a description of an inductive component in this Embodiment will be given referring to FIG. 8. The basic structure of the inductive component is the same as that of the inductive component in Embodiment 1. However, difference lies in that a recess is provided on insulating material 27 of at least either of the top and the bottom surfaces of THP 22. FIG. 8 is an enlarged view of a vicinity of the upper part of THP 22 of the inductive component of this Embodiment. In FIG. 8, insulating material 27 is filled in the space formed by MLM 30 inside THP 22. And a recess is provided on at least either of the top and the bottom surfaces of THP 22. As insulating material 27, an organic resin material such as epoxy resin, silicone resin, and acrylic resin is preferable.

A description of the operation of the inductive component having the above structure will be given below. When mounting the inductive component of this Embodiment onto a power supply circuit board of an electronic device such as a portable telephone, a finished inductive component is sucked and mounted onto the circuit board. In this process, provision of a recess on at least either the top or the bottom surface of THP 22 of the inductive component facilitates suction. The depth of the recess is as required to facilitate suction and the shallower the better. By providing a recess, falling of the inductive component while being sucked and transferred can be prevented. The inductive components of the first to the fourth Embodiments may be covered with a magnetic material, a metal plate, or a multilayer magnetic layer. Leakage flux can be further reduced by such an arrangement. In this case, a recess for suction may be provided on these magnetic layers.

(Embodiment 5)

Next, referring to FIG. 9, a description will be given on an inductive component of this Embodiment. While the basic structure of the inductive component is the same as that of the inductive component of Embodiment 1, difference lies in that slit 91 is provided in the direction of the plane of MLM 30.

Slit 91 is also provided in the direction of the plane of MLM 30 disposed on the bottom surface of coil 21, shown in FIG. 2.

Figure 9:
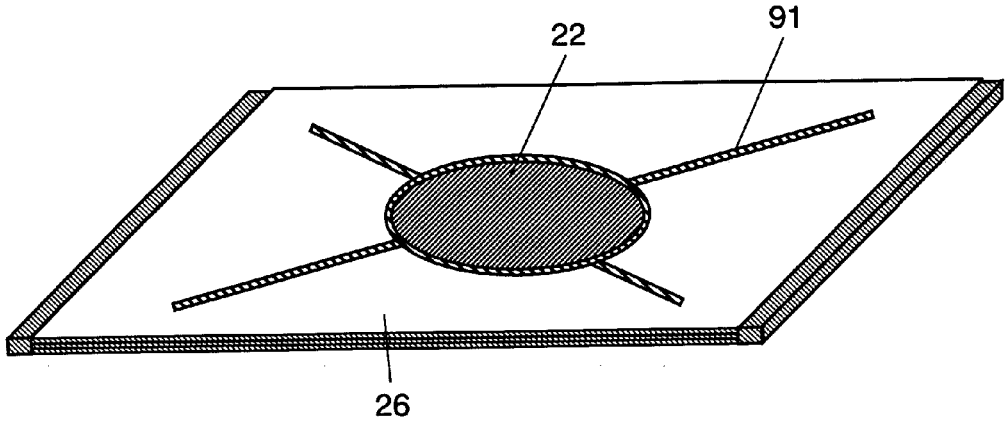
FIG. 9 is a perspective view of a multilayer magnetic layer of Embodiment 5 of the present invention.

In FIG. 9, though four slits 91 are provided, the number may be one, two or more. A description of the operation of an inductive component having the above structure will be given below. When a current is fed to coil 21, magnetic fluxes are generated in the inductive component. Most of the magnetic fluxes are generated in the direction of the planes of MLM 30 disposed on the top and the bottom surfaces of coil 21.

However, as the inductive component becomes smaller in size and lower in profile, magnetic fluxes are also generated in the directions of the thicknesses of multilayer magnetic layers 30 disposed on the top and the bottom surface of coil 21. As these magnetic fluxes generate eddy currents in the direction of the plane of MLM 30 disposed on the top and the bottom surfaces, the inductance is reduced. And, the eddy current generated in the direction of the thickness of MLM 30 causes heat generation from the inductive component. However, as the inductive component of this Embodiment has slits 91 in the direction of the plane of MLM 30, the cross-sectional area of MLM 30 in the direction of the plane can be made small.

Consequently, the eddy current generated in the direction of the plane of MLM 30 disposed on the top and the bottom surfaces can be suppressed. In this way, the inductance of the inductive component can be increased. Also, heat generation from the inductive component can be suppressed. Accordingly, an inductive component having a large enough inductance is obtainable even when the size is made smaller and the profile is made lower. The inductive component of this Embodiment has slits 91 in the direction of the plane of MLM 30 disposed on the top and the bottom surfaces of coil 21. When plating under-layers 28 are to be formed on the top and the bottom surfaces of coil 21, slits 91 are formed in the direction of the plane of plating under-layers 28. As a result, cancellation of the magnetic flux generated in the direction of the thickness of plating under-layers 28 can be prevented. Such an arrangement is preferable as the inductance of the inductive component can be increased. Also, heat generation from the inductive component can be suppressed. In this way, an inductive component having large enough inductance is obtainable even when the size is made smaller and the profile is made lower.

(Embodiment 6)

Figure 10:
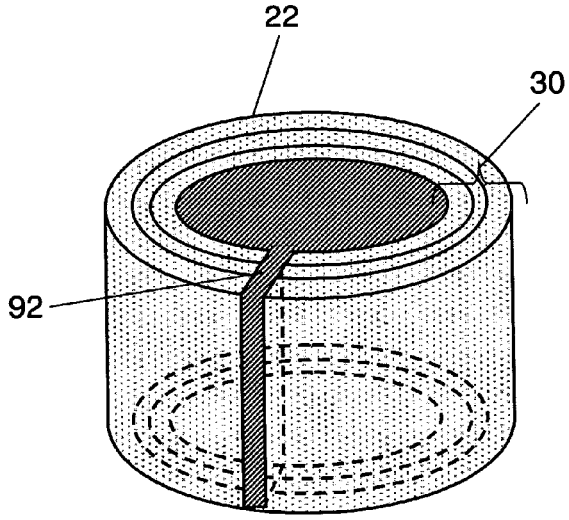
FIG. 10 is an enlarged perspective view of the inner wall of THP of Embodiment 6 of the present invention.
Figure 11:
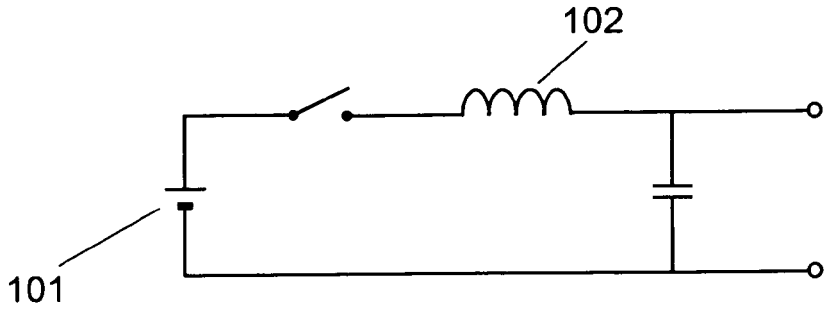
FIG. 11 is a circuit diagram of a power supply circuit used in a portable telephone.
Figure 12:
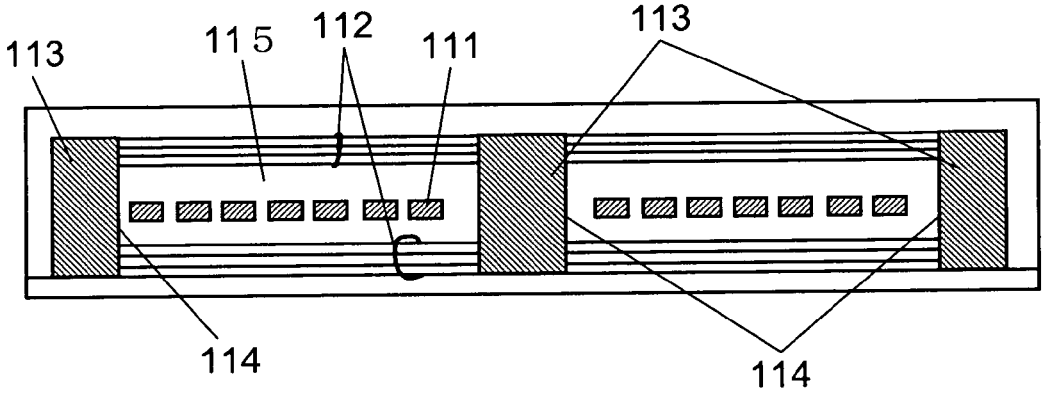
FIG. 12 PRIOR ART
FIG. 12 is a cross-sectional view of a conventional inductive component.

Referring to FIG. 10, a description of an inductive component of this Embodiment will now be given. The basic structure of the inductive component is the same as that of the inductive component of embodiment 1. Difference lies in that slit 92 is formed in the vertical direction from the top to the bottom of MLM 30 formed on the inner wall of THP 22. The operation of an inductive component having this structure will be given in the following. When a current is fed to coil 21, magnetic fluxes are generated in the inductive component. Most of the magnetic fluxes are generated in the top and the bottom surfaces of coil 21 and in the direction of the plane of MLM 30 disposed on the inner wall of THP 22. Furthermore, a vertical magnetic flux is also generated around the center of an empty space formed by MLP 26 in the inner wall of THP 22. An eddy current is generated in the direction of canceling this magnetic flux, especially in the circumferential direction of annular MLM 30 disposed on the inner wall of THP 22. As a result, the inductance decreases.

However, the inductive component of this Embodiment has slit 92 in the vertical direction of MLM 30 formed on the inner wall of THP 22. Accordingly, the eddy current in the circumferential direction can be cut and the inductance of the inductive component can be increased. Also, heat generation from the inductive component can be suppressed. While a single vertical slit is provided in FIG. 10, needless to say, the number of slits may be two or more. Furthermore, it is preferable to provide in the vertical direction a slit with a thinnest possible thickness from the standpoint of obtaining a high inductance.

The width of the slit is in the range 0.01 to 50 μm, preferably 1 to 10 μm. Also, the slit is formed by known methods such as masking-etching method and laser-cut method.

In this way, an inductive component having a high enough inductance is obtainable even when the size is made smaller and the profile is made lower. By the way, even when a slit is provided in the lateral direction of MLM 30 formed on the inner wall of THP 22, it is not possible to cut eddy current in the circumferential direction of MLM 30 formed on the inner wall of THP 22.

INDUSTRIAL APPLICABILITY

The inductive components of the present invention have large enough inductance even when the size is made smaller and the profile is made lower. Accordingly, they are most suitable as inductive components for electronic devices that require smaller size and lower profile. They can be used in power supply circuits of portable telephones, for example.

The invention claimed is:

1. An inductive component comprising:

an insulating layer:

a coil buried in the insulating layer having a top surface and a bottom surface;

a center portion formed from an insulating material;

a multilayer magnetic layer wrapped around the center portion and comprising a plurality of insulating layers and a plurality of magnetic layers such that one is interspersed with the other; and a magnetic material disposed on the top and the bottom surfaces of the coil.

2. An inductive component according to claim 1, wherein the magnetic material is the multilayer magnetic layer.

3. The inductive component of claim 1, wherein the magnetic material is at least one selected from the group consisting a ferrite magnetic material, a composite of ferrite magnetic powder and an insulating resin, and a composite of metallic magnetic powder and an insulating resin.

4. The inductive component of claim 2, wherein an insulating material is filled in a space formed by the multilayer magnetic layer disposed on the inner wall of the through hole.

5. The inductive component of claim 2, wherein the multilayer magnetic layer is formed by alternately laminating the magnetic layer and the insulating layer.

6. The inductive component of claim 2, wherein the multilayer magnetic layer has at least one layer formed by plating.

7. The inductive component of claim 2, wherein the main component of the multilayer magnetic layer includes at least one element selected from the group consisting of Fe, Ni, and Co.

8. The inductive component of claim 2, wherein the thickness of each of the magnetic layers that compose the multilayer magnetic layer formed on the inner wall of the through hole of the coil increases toward the center of the coil.

9. The inductive component of claim 2, wherein the multilayer magnetic layer formed on the inner wall of the through hole of the coil and the multilayer magnetic layer disposed on the top and the bottom surfaces of the coil are formed into an integral unit.

10. The inductive component of claim 9, wherein the thicknesses of magnetic layers of a corner section comprising the multilayer magnetic layer formed on the inner wall of the through hole of the coil and the multilayer magnetic layer disposed on the top and the bottom surfaces of the coil are made greater.

11. The inductive component of claim 4, wherein at least one of the top and the bottom surfaces of the insulating material has a recess.

12. The inductive component of claim 2, wherein a slit is formed in the direction of the plane of the multilayer magnetic layer disposed on the top and the bottom surfaces of the coil.

13. The inductive component of claim 2, wherein a slit is formed at least at one vertical position of the multilayer magnetic layer formed on the inner wall of the through hole.

14. The inductive component of claim 1, wherein the multilayer magnetic layer is formed by alternately laminating a magnetic layer and an insulating layer.

15. The inductive component of claim 1, wherein the multilayer magnetic layer has at least one layer formed by plating.

16. The inductive component of claim 1, wherein the main component of the multilayer magnetic layer includes at least one element selected from the group consisting of Fe, Ni, and Co.

17. The inductive component of claim 1, wherein the thickness of each of the magnetic layers that compose the multilayer magnetic layer formed on the inner wall of the through hole of the coil increases toward the center of the coil.

18. The inductive component of claim 1, wherein the multilayer magnetic layer formed on the inner wall of the through hole of the coil and the multilayer magnetic layer disposed on the top and the bottom surfaces of the coil are formed into an integral unit.

19. The inductive component of claim 14, wherein a slit is formed in the direction of the plane of the multilayer magnetic layer disposed on the top and the bottom surfaces of the coil.

20. An inductive component according to claim 1, wherein the inductive component is included in an electronic device.

21. An electronic device that uses an inductive component, the inductive component comprising:

an insulating layer;

a coil buried in the insulating layer having a top surface and a bottom surface;

a center portion formed from an insulating material;

a multilayer magnetic layer wrapped around the center portion and comprising a plurality of insulating layers and a plurality of magnetic layers such that one is interspersed with the other; and a magnetic material disposed on the top and the bottom surfaces of the coil.

* * * * *